US005832332A

United States Patent [19]

Sugiura

[11] Patent Number: 5,832,332

[45] Date of Patent: Nov. 3, 1998

[54] FIXING UNIT FOR TONER-BASED IMAGE RECORDING APPARATUS

[75] Inventor: Toshio Sugiura, Anjo, Japan

[73] Assignee: Brother Kogyo Kabushiki Kaisha, Nagoya, Japan

[21] Appl. No.: 942,360

[22] Filed: Oct. 2, 1997

[30] Foreign Application Priority Data

Oct. 9, 1996 [JP] Japan ..... 8-287687

[51] Int. Cl.[6] ..... G03G 15/00; G03G 15/20; G03G 21/20

[52] U.S. Cl. ..... 399/44; 399/69; 399/94

[58] Field of Search ..... 399/69, 70, 94, 399/44, 91

[56] References Cited

U.S. PATENT DOCUMENTS 5,321,479 6/1994 Yoshida et al. ..... 399/70
5,640,646 6/1997 Toyohara et al. ..... 399/69

*Primary Examiner*—S. Lee
*Attorney, Agent, or Firm*—Oliff & Berridge, PLC

[57] ABSTRACT

In an apparatus for forming an image using a toner, a toner temperature is maintained below a protective temperature even in a high temperature environment, thereby preventing frequent operational errors caused by an excessive increase in the toner temperature. A standby mode is provided wherein, after a recording operation ends, a fixing heater for heating and fixing the toner is kept at a predetermined temperature for a predetermined period of time so that it is ready for the next recording operation. If the toner temperature exceeds the protective temperature during, for example, a recording operation when the standby mode has been selected, a mode switching control is performed to forcibly discontinue the currently set standby mode and switch to a mode wherein the fixing heater is immediately turned off after a recording operation ends. Thus, the fixing heater will be immediately turned off at the end of the next and later recording operations, thereby significantly reducing a toner temperature increase.

20 Claims, 10 Drawing Sheets

Fig. 3

91A

| SET PROTECTIVE TEMP. | FOR LOW TEMP. MODE | FOR HIGH TEMP. MODE | TONER TEMP. |
|---|---|---|---|
| T1 | 49°C | 47°C | 45°C |
| T2 | 49°C | 47°C | 45°C |
| T3 | 49°C | 47°C | 45°C |
| T4 | 41°C | 41°C | 40°C |
| T5 | 51.3°C | 47.3°C | 45°C |
| T6 | 48°C | 46°C | 43°C |

FIXING UNIT FOR TONER-BASED IMAGE RECORDING APPARATUS

BACKGROUND OF THE INVENTION

1. Field of the Invention

The present invention relates to an image recording apparatus that performs recording by heating and fixing a toner image on a recording medium.

2. Description of the Related Art

A conventional image recording apparatus, such as a facsimile machine, a laser printer, a copying machine and the like, normally has a paper feed mechanism for feeding sheets of paper from a paper cassette one sheet at a time, a process unit that includes a photosensitive drum and a toner container, a laser scanner unit for forming an electrostatic latent image on the photosensitive drum, a transfer mechanism for transferring, onto a paper sheet fed thereto, a toner image formed by applying a toner to the electrostatic latent image on the photosensitive drum, and a fixing mechanism for fixing the toner image transferred to the paper sheet.

This type of image recording apparatus needs to be installed in an environment where the temperature is within a "normal" range of about 15°–35° C. For a waiting state (steady state) during which recording is not performed, the recording apparatus is capable of being selectively set to a standby mode, a sleep mode or a combination of the standby and sleep modes. If a constant standby mode is selected, the apparatus enters a standby state after a recording operation ends. In the first standby state, the fixing heater is constantly and continuously kept at a predetermined temperature, e.g., 135° C., so that the fixing heater temperature can be quickly raised to a fixation-possible temperature, e.g., 190° C., when the next recording operation is initiated.

If a temporary standby mode is selected, the image forming apparatus enters a second standby state after a recording operation ends. In the second standby state, the fixing heater is kept at a predetermined temperature, e.g., 135° C., only for a predetermined time period, e.g., 5–10 minutes. After the predetermined time period, the apparatus enters a sleep state in which the energization of the fixing heater is stopped in order to reduce power consumption.

If the sleep mode is selected, the apparatus stops energizing the fixing heater and enters the sleep state immediately after the recording operation ends in order to reduce power consumption.

The toner, typically comprised of synthetic resin particles with diameters of 7–10 $\mu$m, readily melts, and solidifies or aggregates when heated to a predetermined temperature that varies with the type of toner, e.g., 45° C. However, during the recording operation or the standby state, the toner temperature is unlikely to. rise to the melting point because the toner is typically contained within a substantially sealed toner case that is exposed to "normal" environmental conditions, e.g., 15°–35° C. Therefore, recording can be repeatedly performed.

However, if an image recording apparatus is installed in a high temperature environment, e.g., a temperature of 35°–40° C., various problems arise. If the above-described constant standby mode or temporary standby mode is selected, i.e., the apparatus is set so that when a recording operation ends the apparatus enters a standby state where the fixing heater temperature is maintained at 135° C., release of heat to the environment outside the device is difficult because the internal temperature of the apparatus rises to a level approximately equal to the environmental temperature.

In addition, the fixing heater continuously generates heat. Therefore, the temperature of the toner in the toner case rises to or above the predetermined toner melting temperature, and the toner melts and aggregates. When this happens, the toner will not adhere to an electrostatic latent image on the photosensitive drum.

To counteract this problem, it is possible to set a protective upper temperature limit below which the toner will be maintained in a usable state, e.g., 45° C. The temperature limit is applied in both high and low temperature environments, and the toner temperature is estimated by measuring the temperature near the outside surface of the toner case using a temperature sensor. If the temperature detected by the temperature sensor exceeds the protective temperature, a protective temperature error prevents recording operation and stops the operation of the fixing heater.

However, if the protective temperature is set to a high value, the apparatus internal temperature will likely rise to a higher temperature in a high temperature environment because heat dissipation is more difficult in a high temperature environment than in a low temperature environment. Conversely, if the protective temperature is set to a low value, the protective temperature error will occur frequently even when the toner temperature has not risen to the toner melting temperature.

SUMMARY OF THE INVENTION

Accordingly, it is an object of the present invention to control the heat generated by the fixing heater in order to prevent the toner contained in a toner container portion from rising above a protective temperature, regardless of whether the image forming apparatus is installed in a high temperature environment or a low temperature environment. Another object of the present invention is to reduce the incidence of recording interruptions caused by unnecessary protective temperature errors by varying the criteria for determining a protective temperature error based on environmental conditions.

According to one aspect of the present invention, an image forming apparatus is provided wherein a toner image formed on a recording medium is fixed on the recording medium by heating the toner image using a fixing heater. The image forming apparatus has a temperature detecting device for detecting the temperature of the toner contained in a toner container portion, and a recording stopping device for stopping a recording operation if the temperature detected by the temperature detecting device exceeds a predetermined set protective temperature. A mode setting device is provided for alternatively setting a first mode or a second mode.

In the first mode, a standby state is maintained for a predetermined length of time after a recording operation ends. In the standby state, the fixing heater is kept at a predetermined temperature. If the next recording operation is not started within the predetermined length of time, the standby state is discontinued and the fixing heater is turned off. In the second mode, the fixing heater is continuously kept at a predetermined temperature after a recording operation ends.

Furthermore, a mode switching device is provided for switching the second mode to the first mode if a recording operation is stopped by the recording stopping device while the second mode is in effect.

The first mode or the second mode is alternatively set by the mode setting device. A toner temperature, reflecting the temperature of the toner contained in the toner container portion, is detected by the temperature detecting device. If the toner temperature exceeds a predetermined set protective temperature, a recording operation is stopped (or prohibited) by the recording stopping device. If a recording operation is stopped by the recording stopping device when the second mode has been set by the mode setting device, the second mode is switched to the first mode by the mode switching device.

Specifically, when a protective temperature error occurs, indicating that the detected toner temperature exceeds the set protective temperature, the current recording operation is stopped, and the second mode is switched to the first mode. In the first mode, the standby state, during which the fixing heater is kept at a predetermined temperature, is maintained for a predetermined length of time. If the next recording operation is not started within the predetermined length of time, the standby state is discontinued and the fixing heater is turned off.

In a situation where the predetermined length of time is set to a short time period, e.g., several minutes, the fixing heater is turned off a relatively short period of time after a recording operation ends. Since the amount of heat generated by the fixing heater is thereby reduced, the internal temperature of the image recording apparatus can be kept relatively low, thereby keeping the toner temperature sufficiently low. Accordingly, occurrence of an unnecessary protective temperature error can be substantially prevented during the next recording operation.

According to another aspect of the present invention, an image forming apparatus is provided wherein a toner image formed on a recording medium is fixed on the recording medium by heating the toner image using a fixing heater. The image forming apparatus has a temperature detecting device for detecting a temperature of the toner contained in a toner container portion, and a recording stopping device for stopping a recording operation if the toner temperature exceeds a predetermined set protective temperature. A mode setting device is provided for alternatively setting a first or a third mode.

In the first mode, a standby state, in which the fixing heater is kept at a predetermined temperature, is maintained for a predetermined length of time after a recording operation ends. If the next recording operation is not started within the predetermined length of time, the standby state is discontinued and the fixing heater is turned off. In the third mode, the fixing heater is immediately turned off when a recording operation ends.

Furthermore, a mode switching device is provided for switching the first mode to the third mode if a recording operation is stopped by the recording stopping device while the first mode is in effect.

The first mode or the third mode is alternatively set by the mode setting device. A toner temperature, reflecting the temperature of the toner contained in the toner container portion, is detected by the temperature detecting device. If the toner temperature exceeds a predetermined set protective temperature, a recording operation is stopped by the recording stopping device. If a recording operation is stopped by the recording stopping device when the first mode has been set by the mode setting device, the first mode is switched to the third mode by the mode switching device.

Specifically, when a protective temperature error occurs, indicating that the detected toner temperature exceeds the set protective temperature, the current recording operation is stopped, and the first mode is switched to the third mode. In the third mode, the fixing heater is immediately turned off when a recording operation ends. Since the heat generated by the fixing heater after the end of a recording operation is thereby reduced, the internal temperature of the image forming apparatus can be kept relatively low, thereby keeping the toner temperature sufficiently low. Accordingly, occurrence of an unnecessary protective temperature error can be substantially prevented during the next recording operation.

According to still another aspect of the present invention, an image forming apparatus is provided wherein a toner image formed on a recording medium is fixed on the recording medium by heating the toner image using a fixing heater. The image forming apparatus has a temperature detecting device for detecting the temperature of toner contained in a toner container portion, and a recording stopping device for stopping a recording operation if the toner temperature exceeds a predetermined set protective temperature. A heater control device is provided for maintaining a standby state, during which the fixing heater is kept at a predetermined temperature for a predetermined length of time after a recording operation ends, and for discontinuing the standby state if the next recording operation is not started within the predetermined length of time. Further, a set time changing device is provided for reducing the predetermined length of time, when a recording operation is stopped by the recording stopping device, thereby maintaining the standby state for a length of time that is shorter than the predetermined length of time.

The standby state, during which the fixing heater is kept at a predetermined temperature, is maintained by the heater control device for a predetermined length of time after a recording operation ends. If the next recording operation is not started within the predetermined length of time, the heater control device discontinues the standby state wand turns off the fixing heater. Accordingly, the image forming apparatus is able to quickly start the next recording operation if it has remained in the standby state. However, if the next recording operation is not initiated before the predetermined length of time, the fixing heater is turned off to reduce power consumption.

The temperature of the toner contained in the toner container portion is detected by the temperature detecting device. If the toner temperature exceeds a predetermined set protective temperature, the current recording operation is stopped by the recording stopping device. Subsequently, the predetermined length of time is changed so that the standby state is maintained for a shorter period of time. Therefore, the fixing heater is turned off a relatively short period of time after a recording operation ends. Since the amount of heat generated by the fixing heater is thereby reduced, the internal temperature of the image forming apparatus is kept relatively low, thereby keeping the toner temperature sufficiently low. Accordingly, occurrence of an unnecessary protective temperature error can be substantially prevented during the next recording operation.

According to a further aspect of the present invention, an image forming apparatus is provided wherein a toner image formed on a recording medium is fixed on the recording medium by heating the toner image using a fixing heater. The image forming apparatus has a temperature detecting device for detecting the temperature of toner contained in a toner container portion, and a recording preventing device for preventing a recording operation if the toner temperature exceeds a predetermined set protective temperature. A mode setting control device is provided for setting a high temperature mode if a predetermined high temperature mode setting condition is satisfied, and for otherwise setting a low temperature mode. The protective temperature set for the recording preventing device is determined according to which temperature mode is set. The set protective temperature for the low temperature mode is higher than the set protective temperature for the high temperature mode.

The temperature of the toner contained in the toner container portion is detected by the temperature detecting device. If the toner temperature exceeds the set protective temperature, recording is prevented by the recording preventing device. When the high temperature mode has been set, the recording preventing device uses the high temperature mode protective temperature to determine whether the toner temperature has exceeded the set protective temperature. When the low temperature mode has been set, the recording preventing device uses the low temperature mode protective temperature, which is higher than the high temperature mode protective temperature, to determine whether the toner temperature has exceeded the set protective temperature.

In the high temperature mode, which is preferably set when the image forming apparatus is in a high temperature environment and the internal temperature of the image forming apparatus is relatively high, the toner temperature is compared in magnitude with the high temperature mode protective temperature, which is lower than the low temperature mode protective temperature. The temperature increase inside the image forming apparatus can thereby be reduced so that the toner temperature can be kept at a level that will not adversely affect the toner. In the low temperature mode, which is preferably set when the image forming apparatus is in a low temperature environment and the internal temperature of the image forming apparatus is relatively low, the toner temperature is compared in magnitude with the low temperature mode protective temperature, which is higher than the high temperature mode protective temperature. Accordingly, unnecessary protective temperature errors are substantially prevented.

A recording set protective temperature that is applied while a recording operation is being performed, and a waiting set protective temperature that is otherwise applied and that is lower than the recording set protective temperature, may also be used as protective temperatures in the recording preventing device. During a predetermined length of time after a recording operation is stopped, the recording preventing device uses the recording set protective temperature instead of the waiting set protective temperature.

During the predetermined length of time after a recording operation is stopped, the toner temperature decreases gradually from the toner temperature during the recording operation, even if a cooling fan is employed. Therefore, it is advantageous for the recording preventing device to use the recording set protective temperature, which is higher than the waiting set protective temperature, to thereby substantially prevent unnecessary protective temperature errors after the recording operation ends. After the predetermined length of time elapses, the recording prevention device uses the waiting set protective temperature.

According to yet another aspect of the present invention, an image forming apparatus is provided wherein a toner image formed on a recording medium is fixed on the recording medium by heating the toner image using a fixing heater. The image forming apparatus has a temperature detecting device for detecting a temperature of the toner contained in a toner container portion, and a recording preventing device for preventing a recording operation if the toner temperature exceeds a predetermined set protective temperature. A recording set protective temperature that is applied while a recording operation is being performed, and a waiting set protective temperature that is otherwise applied and that is lower than the recording set protective temperature, are used as set protective temperatures for the recording preventing device. During a predetermined length of time after a recording operation is stopped, the recording preventing device evaluates the toner temperature based on the recording set protective temperature.

The temperature of the toner in the toner container portion is detected by the temperature detecting device. If the toner temperature exceeds the set protective temperature, recording is prevented by the recording preventing device. As described above, during the predetermined length of time after a recording operation is stopped, the toner temperature decreases gradually from the toner temperature during the recording operation, even if a cooling fan is employed. Therefore, it is advantageous for the recording preventing device to use the recording set protective temperature, which is higher than the waiting set protective temperature.

A recording medium stores a control program that includes instructions for use by the control unit of the image forming apparatus to perform the control procedures described above. The control program can be stored in a memory of the image forming apparatus in advance, for example, by the manufacturer or retailer of the image forming apparatus. Alternatively, the control program, including predetermined set temperature values, can be provided separately from the image forming apparatus, for example, on CD-ROM or other storage media that can be purchased by the user and subsequently stored (permanently or temporarily) in internal memory of the image forming apparatus. The program also can be provided to the user over a communications network such as, for example, the Internet (World Wide Web). Thus, the recording medium can be internal ROM or RAM (volatile or non-volatile) of the image forming apparatus, or a separate memory such as a CD-ROM, floppy disk, etc.

BRIEF DESCRIPTION OF THE DRAWINGS

A preferred embodiment of the present invention will be described in detail, with reference to the following figures, wherein:

FIG. 3 is a table listing set protective temperature data;

DETAILED DESCRIPTION OF PREFERRED EMBODIMENT

A preferred embodiment of the present invention will now be described in detail with reference to the accompanying figures.

In a preferred embodiment, the present invention is applied to a facsimile apparatus having an operating panel, a feeder unit, a laser printer, and an image reading device.

Figure 1:
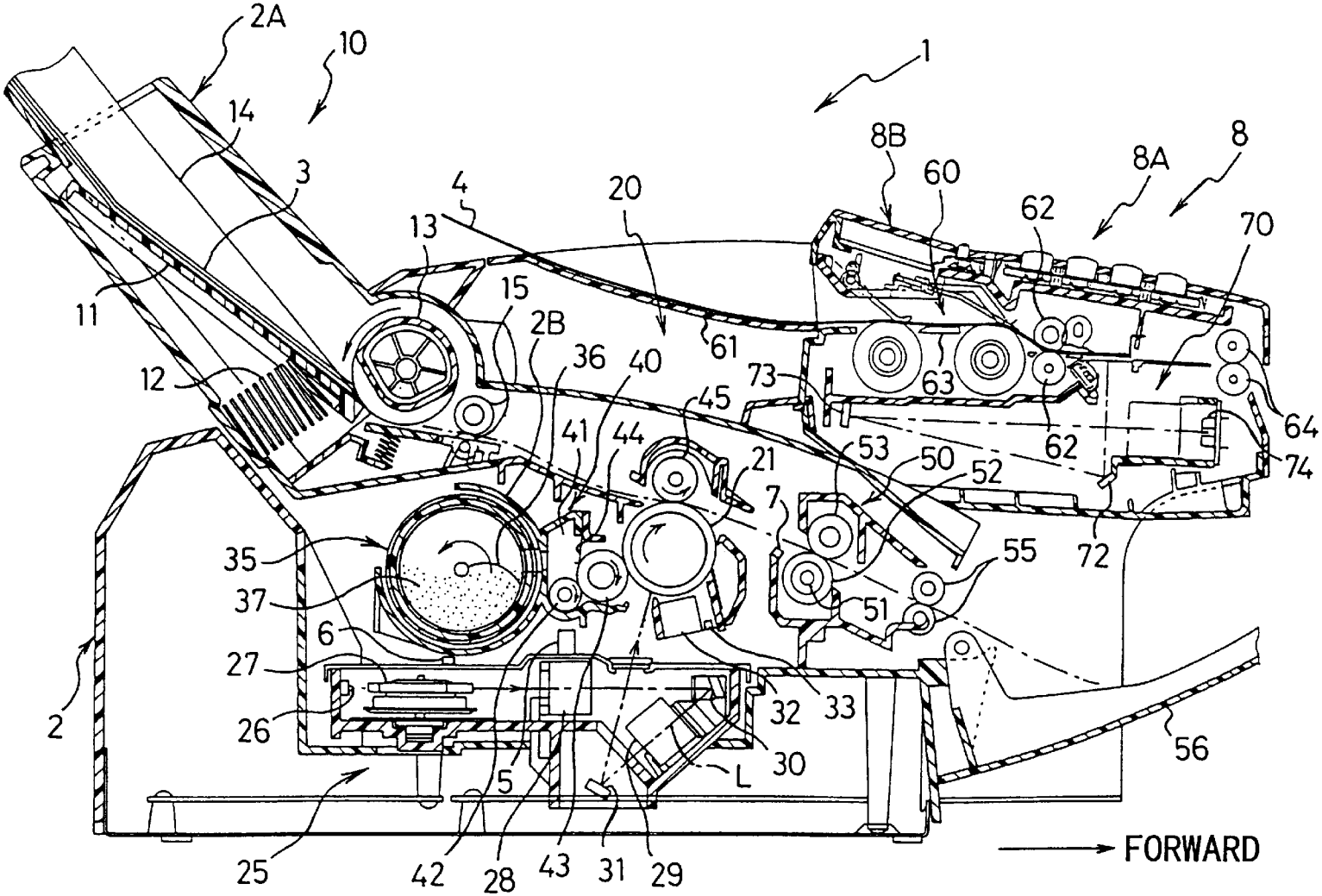
FIG. 1 is a sectional view of a facsimile apparatus employing the present invention.

Referring to FIG. 1, a body case 2 of a facsimile apparatus 1 encases a feeder unit 10 for feeding a paper sheet 3, a laser printer 20 having a laser scanner unit 25 and a photosensitive drum 21, an image reading device 70, a drive mechanism (not shown) for driving a drive system that includes the photosensitive drum 21 and various rollers, and a control unit 80 (see FIG. 2) for controlling the facsimile apparatus 1.

The feeder unit 10 will be described first. A paper pressure plate 11 is disposed in a feeder unit case 2A formed in an upper rear end portion of the body case 2. A front end portion of the paper pressure plate 11 is elastically urged upward by a compressed spring 12. A paper feed roller 13, for feeding a paper sheet 3, is rotatably journaled to the body case 2. The paper feed roller 13 is rotated at a predetermined feed rate by a drive mechanism (not shown).

A paper cassette 14, capable of containing a plurality of paper cut-sheets 3 of a regular size, is detachably set in an inclined posture in the feeder unit case 2A. The paper sheets 3 contained in the paper cassette 14 are fed one at a time by rotation of the paper feed roller 13. A pair of register rollers 15 for registering the leading edge of a paper sheet 3 fed thereto are rotatably journaled separately at locations downstream in the conveying direction i.e., from the paper feed roller 13, i.e., a direction from the rear end to the front end in FIG. 1.

The laser printer 20 is provided with the photosensitive drum 21, the laser scanner unit 25 for forming an electrostatic latent image on the photosensitive drum 21, a toner box 35, a developing unit 40 having a developing roller 43, a transfer roller 45 for transferring a toner image from the photosensitive drum 21 onto a paper sheet 3, a fixing unit 50, and a drive mechanism for driving the photosensitive drum 21, the developing roller 43 and the like.

The photosensitive drum 21 is a hollow drum on which a photoelectro-conductive layer of a predetermined thickness, e.g., about 20 $\mu$m, is formed of a dispersion of photoelectro-conductive resin in polycarbonate on an outer periphery of a cylindrical aluminum sleeve. The photosensitive drum 21 is rotatably journaled to the body case 2.

The laser scanner unit 25 is disposed below the photosensitive drum 21. The laser scanner unit 25 has a semiconductor laser light emitter 26 for emitting laser light L to form an electrostatic latent image on the photosensitive drum 21. The laser scanner unit 25 also comprises a polygonal mirror (pentahedronal mirror) 27, a pair of lenses 28 and 29, and a pair of reflecting mirrors 30 and 31. Laser light L from the semiconductor laser light emitter 26 scans over the photosensitive drum 21, via the polygonal mirror 27, thereby forming an electrostatic latent image.

A scorotron-type charger 32 uniformly charges the photosensitive drum 21 by generating corona discharge from a charging wire formed of tungsten or the like, and is disposed near the photosensitive drum 21 at a location advanced in rotational angular position from a position that is irradiated with laser light L. Disposed at a location further advanced in rotational angular position is a static eliminator lamp 33 for eliminating residual charges from the photosensitive drum 21.

The developing unit 40 and the toner box 35 disposed in the rear of the photosensitive drum 21 will now be described. The toner box 35 is detachably attached to a developing unit case 2B, and has a double-walled cylindrical configuration containing an electrically insulating toner 37 and a rotationally driven agitator 36. Provided forward of the toner box 35, is a toner reservoir 41 for storing toner supplied through a toner feed opening formed in the toner box 35 by rotation of the agitator 36. A toner feed roller 42 for conveying the toner 37 is rotatably journaled to the toner reservoir 41. The developing roller 43 for conveying the toner 37 to the photosensitive drum 21 is rotatably disposed in contact with the toner feed roller 42 and the photosensitive drum 21, and extends across a front side of the toner reservoir 41.

The toner 37 is preferably comprised of 7–10 $\mu$m diameter synthetic resin particles. The toner feed roller 42 and the developing roller 43 are preferably formed of an electrically conductive rubber, e.g., silicone rubber.

An elastic thin-plate layer thickness restricting blade 44, preferably formed of stainless steel or phosphor bronze, is attached to the developing unit case 2B, and extends downward. A bent portion formed in a lower end portion of the layer thickness restricting blade 44 pressingly contacts the developing roller 43. The layer thickness restricting blade 44 thereby restricts the layer thickness of the toner 37 on the developing roller 43. Toner is supplied from the toner feed roller 42 and attached to the developing roller 43 in the form of a layer.

A cooling fan 5 is disposed immediately under the developing unit 40. The cooling fan 5 is driven to specifically cool the toner box 35 in order to prevent solidification or aggregation of the toner due to high temperatures, thereby preventing image quality deterioration. A toner temperature detecting sensor 6, preferably formed of a thermistor, is disposed immediately under and adjacent to the outer surface of the toner box 35. The output from the toner temperature detecting sensor 6 indicates the temperature of the toner 37.

When the photosensitive drum 21, the toner feed roller 42, the developing roller 43, and the like are driven in their respective predetermined rotational directions by the drive mechanism, particles of the toner 37 become electrostatically charged with positive polarity due to rubbing between the toner feed roller 42 and the developing roller 43, and the press-friction of the layer thickness restricting blade 44 with the developing roller 43. The positively charged toner 37 attaches to an electrostatic latent image formed on the photosensitive drum 21 by laser light L. Through reversal development, a toner image is formed.

The transfer roller 45 is preferably formed of an electrically conductive rubber, e.g., silicone rubber, and is in contact with and rotatably journaled above the photosensitive drum 21. The transfer roller 45 reliably transfers the toner image from the photosensitive drum 21 onto a paper sheet 3.

The fixing unit 50, disposed downstream in the conveying direction from the photosensitive drum 21, has a heat roller 52 containing a fixing heater 51, preferably formed of a halogen lamp, and a pressure roller 53. The paper sheet 3 is conveyed between the heat roller 52 and the pressure roller 53, so that the toner image is transferred to a downward facing surface of the paper sheet 3 and is pressed and heated, thereby becoming fixed to the paper sheet 3. A heater temperature detecting sensor 7, preferably formed of a thermistor, is disposed adjacent to the heat roller 52. The surface temperature of the heat roller 52 is detected by the heater temperature detecting sensor 7.

Provided downstream from the fixing unit 50 are a pair of paper convey rollers 55 and a paper discharge tray 56. The paper feed roller 13, the register rollers 15, the toner feed roller 42, the developing roller 43, the transfer roller 45, the pressure roller 53 and the paper convey rollers 55 are rotated by an LF motor 85 (see FIG. 2) through a gear mechanism (not shown).

A document conveying device 60, for conveying a document, and the image reading device 70 will now be described. An operating panel 8 is provided in a forward upper portion of the body case 2. The operating panel 8 has a liquid crystal display 8B and a keyboard 8A with a power switch, a mode setting switch, number keys and various function keys. The document conveying device 60 and the image reading device 70, for reading an image recorded on a document 4, are disposed below the operating panel 8. The document 4 placed on a document receptacle 61 is conveyed by the document conveying device 60, that comprises a pair of convey rollers 62, a paper guide 63, a pair of convey rollers 64, and the like, to a document reading position of the image reading device 70. The convey rollers 62 and 64 are rotated by a document convey motor 86 (see FIG. 3) through a gear mechanism (not shown). The document convey motor 86 is drive-controlled by the control unit 80.

The image reading device 70 has a light emitter 71 (see FIG. 2), mirrors 72 and 73, and a reading head 74 formed of a charge coupled device (CCD) comprising a plurality of light receiving elements. The image reading device 70 reads the image from the document one scanning line at a time by the light emitter 71 emitting light to the document 4 and mirrors 72 and 73 directing light reflected from the document 4 to the reading head 74. The light receiving elements of the reading head 74 are preferably photoelectric conversion elements that output voltage in accordance with the intensity of the light detected. An analog signal, indicating the magnitude of the output voltage of the photoelectric conversion elements, is supplied to the control unit 80.

The control system of the facsimile apparatus 1 will now be described with reference to FIG. 2. The control unit 80 for controlling the facsimile apparatus 1 is connected separately to a communication line 82, for connection to a separate device 81, the keyboard 8A, a display controller 83 for controlling the display 8B, a polygonal mirror motor 84, the semiconductor laser light emitter 26, the toner temperature detecting sensor 6, the heater temperature detecting sensor 7, the fixing heater 51, the cooling fan 5, the light source 71, the reading head 74, the LF motor 85, and the document convey motor 86. The control unit 80 has a microcomputer preferably comprised of a CPU 90, a RAM 92, and a ROM 91 for storing various control programs for controlling the facsimile apparatus 1, including recording control, image reading control, and various other control programs.

The temperature of the toner 37 becomes substantially equal to the temperature outside the facsimile apparatus 1, i.e., environmental temperature, while image recording and image reading is not being performed. However, when image reading or image recording is performed, the toner temperature rises above the environmental temperature due to heat generated by the fixing unit 70 and the various motors 84–86. The environmental temperature can be relatively low, e.g., about 20° C., or relatively high, e.g., about 40° C., depending on where the facsimile apparatus 1 is installed. Accordingly, the facsimile apparatus 1 provides a low temperature mode that is used when the environmental temperature is lower than approximately 36° C., and a high temperature mode that is used when the environmental temperature is higher than approximately 36° C.

FIG. 3 shows set protective temperatures T1–T6, which are used for determining a protective temperature error when the temperature of the toner 37 becomes undesirably high during or after a recording operation, or while the facsimile apparatus 1 is in a steady state. Thus, as used herein, the word "prohibiting" is meant to encompass the act of preventing a recording operation from starting as well as the act of stopping a recording operation in progress. The set protective temperatures T1–T6 are stored in a set protective temperature memory 91A of the ROM 91.

Specifically, when the facsimile apparatus 1 is in a standby state, in which the temperature of the fixing heater 51 is maintained at 135° C., it is determined whether the toner temperature is too high by comparing the toner temperature to the set protective temperature T1.

The set protective temperature T2 is used to determine if the toner temperature is too high when a recording operation is completed normally. The set protective temperature T3 is used to determine if the toner temperature is too high when the facsimile apparatus 1 is in the steady state, i.e., a state where recording is not performed and the fixing heater 51 is off. The set protective temperature T4 is used to determine whether to stop driving the cooling fan 5 in the steady state. Specifically, the cooling fan 5 is stopped when the toner temperature is below the temperature T4. The set protective temperature T5 is used to determine if the toner temperature is too high during recording. The set protective temperature T6 is used to determine if the toner temperature is too high when the facsimile apparatus 1 enters the steady state after a recording operation has been forcibly stopped.

For each of the set protective temperatures T1–T6, the set protective temperature memory 91A stores a low temperature mode set protective temperature, that is applied when the low temperature mode is set, and a high temperature mode set protective temperature that is applied when the high temperature mode is set.

For the set protective temperatures T1–T3, T5 and T6, the low temperature mode set protective temperatures are higher than the high temperature mode set protective temperatures, as shown in the table of FIG. 3.

In the preferred embodiment, the set protective temperature T5 is used as the set protective temperature while recording is being performed. The set protective temperatures T1–T3 are lower than the recording set protective temperature T5, and are used as set protective temperatures when recording is not being performed.

In the facsimile apparatus 1, the standby mode and the sleep mode can be alternatively set. In the standby mode, a standby state is established during which a predetermined temperature, e.g., 135° C., is maintained for a predetermined length of time after a recording operation ends. If the next recording operation is not started within the predetermined length of time, the standby state is discontinued and switched to a sleep state, in which the fixing heater 51 is turned off in order to reduce power consumption.

In the sleep mode, the facsimile apparatus 1 is brought into the sleep state at the end of a recording operation by turning off the fixing heater 51.

Figure 4:
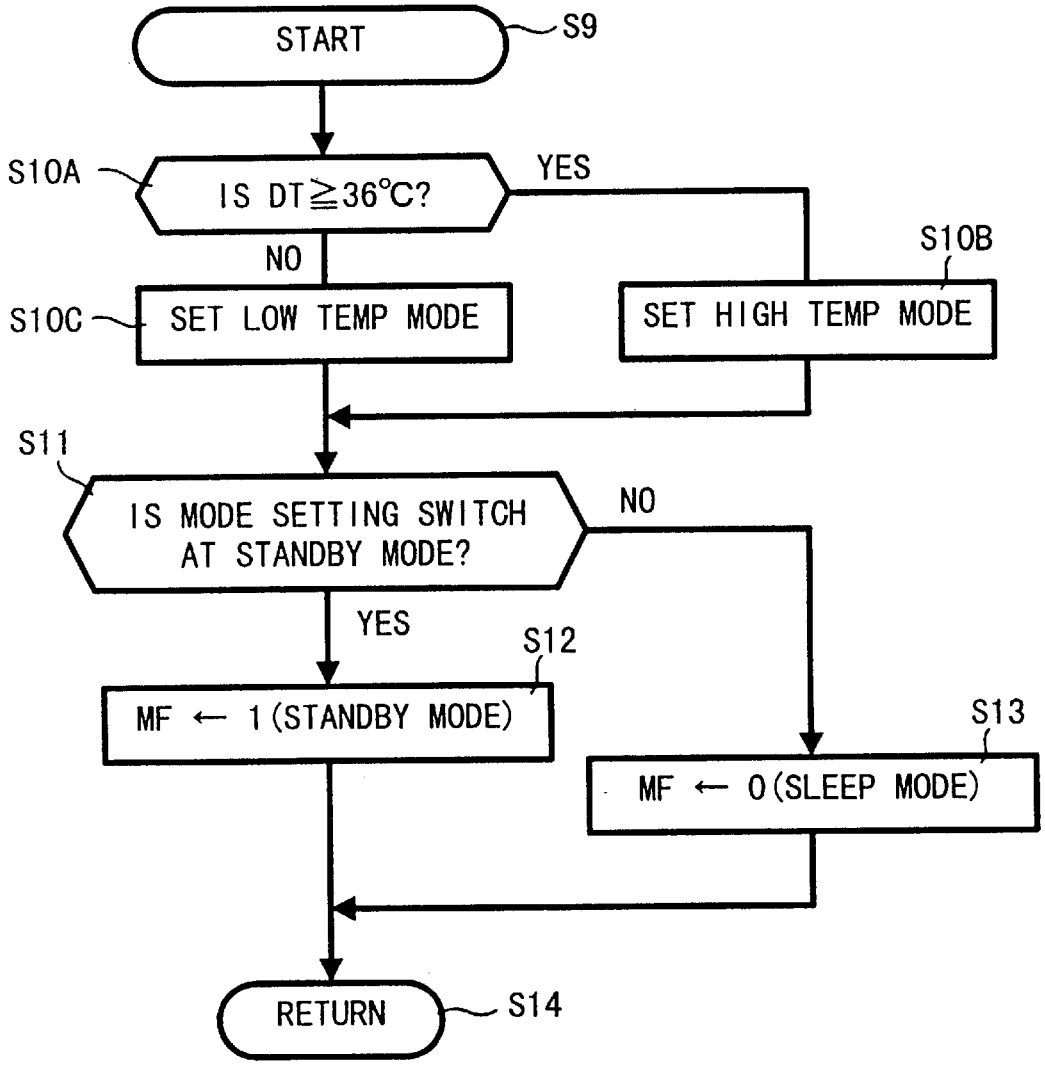
FIG. 4 is a flowchart of a preferred control routine for setting an operational mode.

FIG. 4 shows a preferred control routine for setting an operational mode. The routine starts at step S9 and proceeds to step S10A, where the control system determines if the toner temperature DT is equal or greater than 36° C.

The control system detects the toner temperature DT based on a detection signal input from the toner temperature detecting sensor 6 at a predetermined time, e.g., 8:00 a.m., while image recording or image reading is not being performed. Thus, the toner temperature DT is detected at a point in time when the temperature inside the facsimile apparatus 1 is substantially equal to the environmental temperature, i.e., the ambient temperature around the facsimile apparatus 1.

If the toner temperature DT is greater than or equal to 36° C., control continues to step S10B. Otherwise, control jumps to step S10C.

At step S10B, the control system sets a high temperature operational mode. Control then continues to step S11.

At step S10C, the control system sets a low temperature operational mode. Control then continues to step S11, where the control system determines if the mode setting switch on the keyboard 8A is set for the standby mode. If so, control continues to step S12. Otherwise, control jumps to step S13.

At step S12, the control system sets the facsimile apparatus 1 to the standby mode by setting a mode flag MF to 1. Control then continues to step S14, where the control system returns to a main routine. At step S13, the control system sets the facsimile apparatus to a sleep mode by setting the mode flag MF to zero. Control then continues to step S14.

Figure 5:
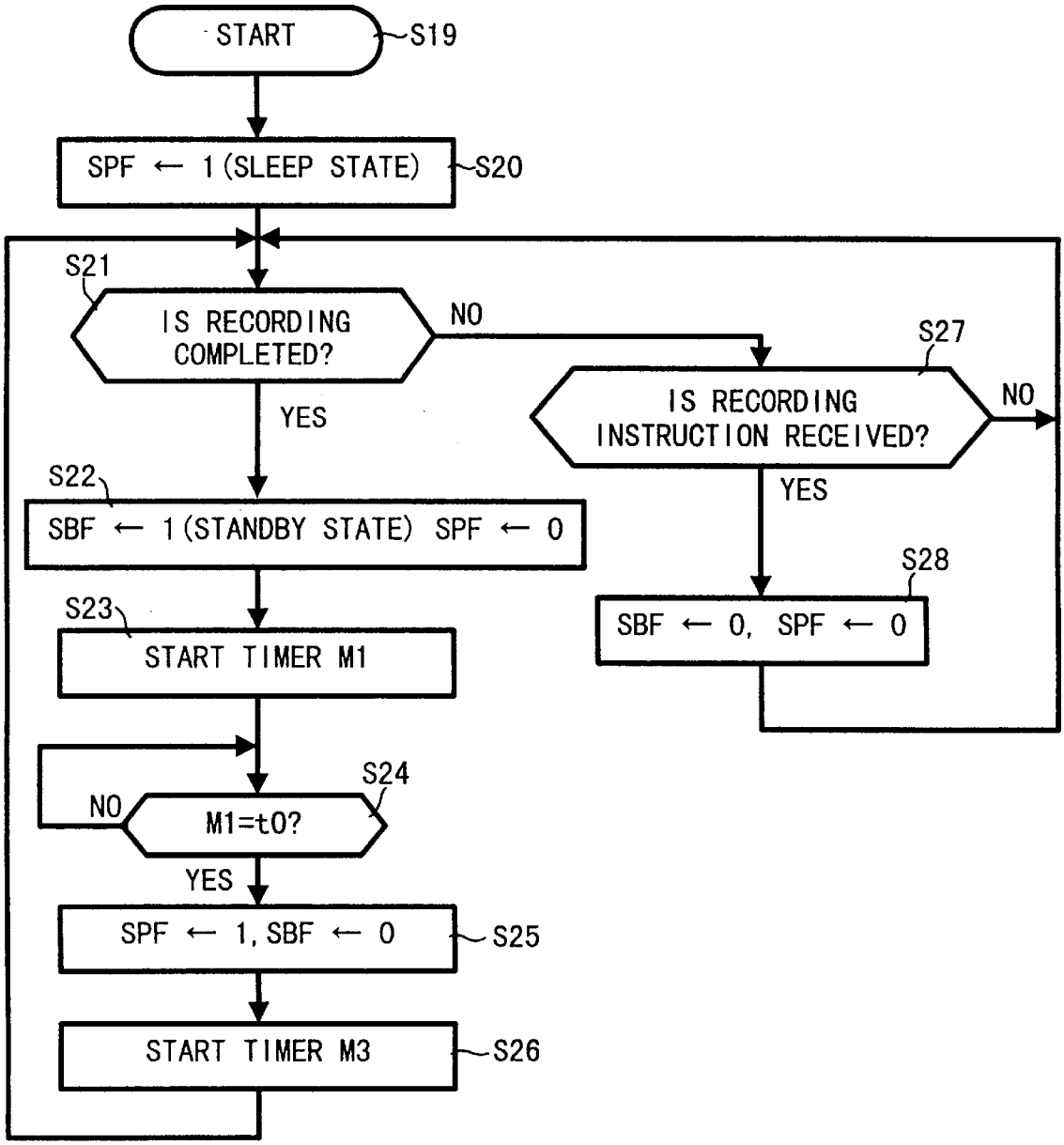
FIG. 5 is a flowchart of a preferred control routine for setting an operational state during a standby mode.

FIG. 5 shows a preferred control routine for setting an operational state during the standby mode. The routine starts at step S19 and proceeds to step S20, where the control system sets the facsimile apparatus 1 into a sleep state by setting a sleep state flag SPF to 1.

Next, at step S21, the control system determines if image recording has been completed. If image recording has been completed, control continues to step S22. Otherwise, control jumps to step S27.

At step S22, the control system sets the facsimile apparatus 1 to a standby state by setting the standby state flag SBF to 1 and setting the sleep state flag SPF to zero. Next, at step S23, a timer Ml for counting a standby set time is cleared to an initial count value and started. Control then continues to step S24, where the control system determines if the counter M1 has reached a predetermined standby set time t0. If so, control continues to step S25. Otherwise, step S24 is repeated until the counter M1 has reached the predetermined standby set time t0. During this period of time, the fixing heater 51 is energized so that the surface temperature of the heat roller 52 is maintained at approximately 135° C., as described above.

Next, at step S25, the control system sets the facsimile apparatus 1 to a sleep state by setting the sleep state flag SPF to 1 and the standby state flag SBF to zero. Control then continues to step S26, where the control system initializes and starts a timer M3. Control then returns to step S21.

At step S27, the control system determines if an image recording instruction has been received from a recording control device. If so, control continues to step S28. Otherwise, control returns to step S21. At step S28, the control system resets the standby state flag SBF and the sleep state flag SPF to zero so that the facsimile apparatus 1 is in neither the sleep state nor the standby state. Control then returns to step S21.

Figure 6:
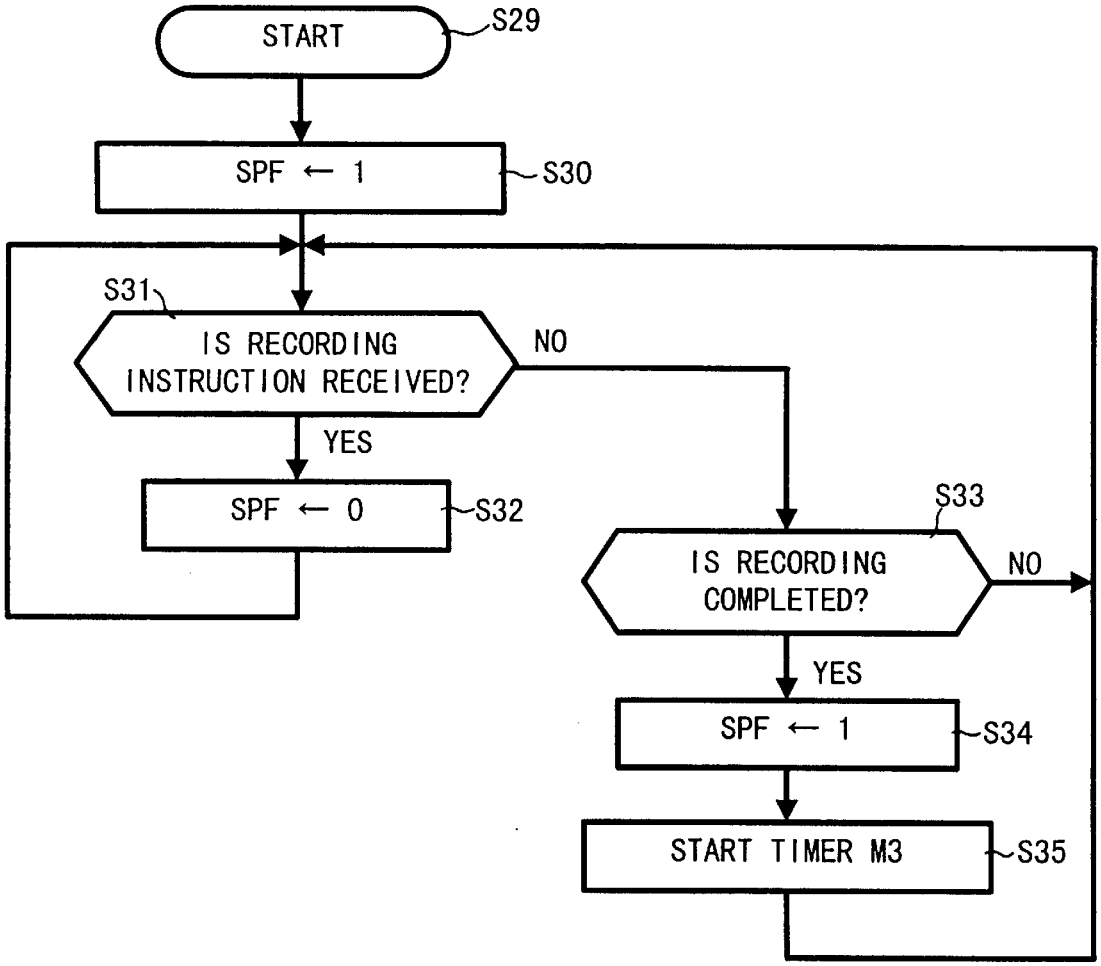
FIG. 6 is a flowchart of a preferred control routine for setting a sleep state during a sleep mode.

FIG. 6 shows a preferred control routine for setting a sleep state during a sleep mode. As described above, the sleep mode is a mode in which when an image recording operation is completed, the energization of the fixing heater 51 is immediately stopped, thereby bringing the facsimile apparatus into a sleep state.

The routine starts at step S29 and proceeds to step S30, where the control system establishes the sleep state by setting the sleep state flag SPF to 1. Next, at step S31, the control system determines if an image recording instruction has been received from the recording control device. If so, control continue to step S32. Otherwise, control jumps to step S33.

At step S32, the control system discontinues the sleep state by resetting the sleep state flag SPF to zero. Control then returns to step S31.

At step S33, the control system determines if image recording has been completed. If so, control continues to step S34. Otherwise, control returns to step S31. At step S34, the control system establishes the sleep state by setting the sleep state flag SPF to 1. Control then continues to step S35, where the control system initializes and starts the timer M3. Control then returns to step S31.

Figure 7:
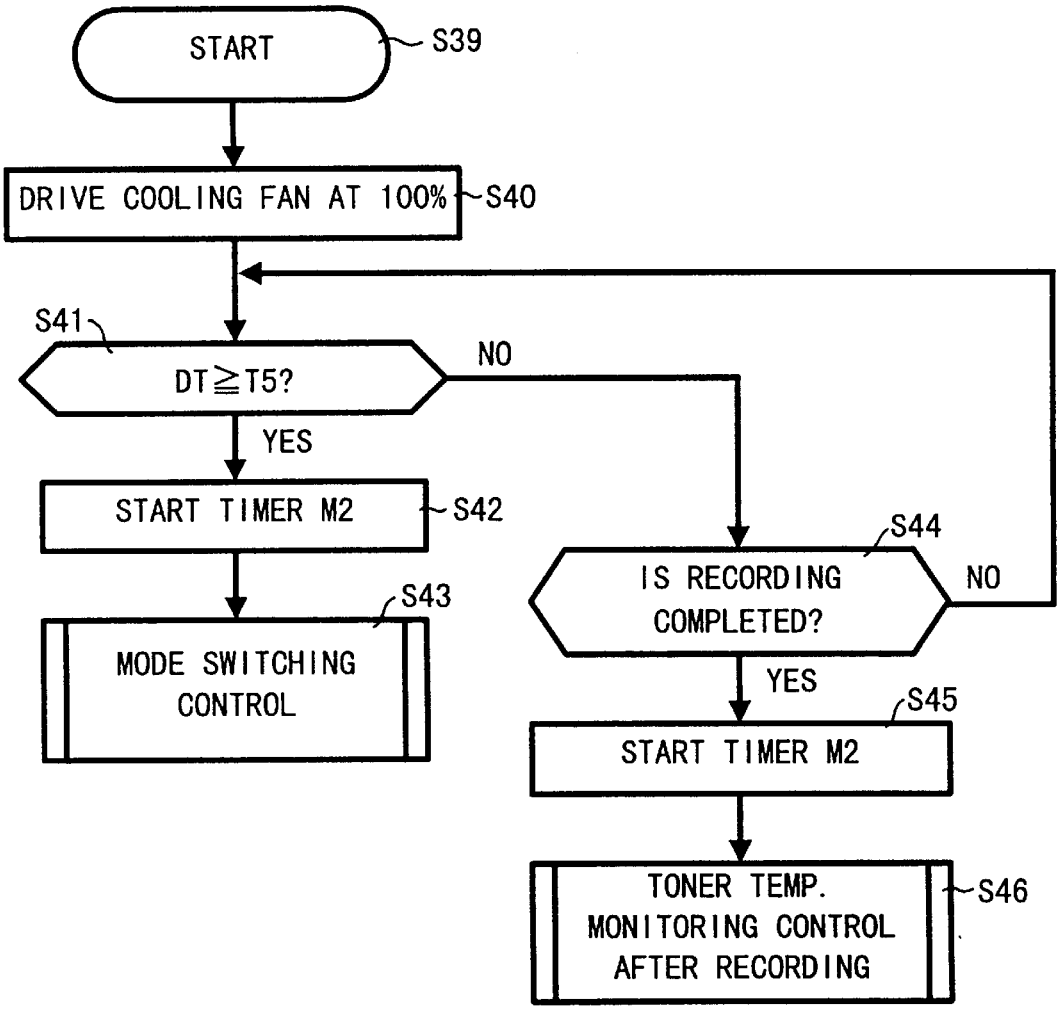
FIG. 7 is a flowchart of a preferred control routine for monitoring toner temperature during image recording.

FIG. 7 shows a preferred control routine for monitoring the toner temperature. The routine starts, when an image recording operation is started, at step S39, and proceeds to step S40, where the control system drives a cooling fan for the toner box 35 at 100% capacity. Thus, the toner box 35 is cooled.

Next at step S41, the control system determines the toner temperature based on the output from the toner temperature detecting sensor 6. The control system determines if the toner temperature DT is greater than or equal to the set protective temperature T5. If the toner temperature DT is greater than or equal to the set protective temperature T5, control continues to step S42. Otherwise, control jumps to step S44.

At step S42, the control system initializes and starts the timer M2, which counts the elapsed time after the end of an image recording operation. Control then continues to step S43, where the control system executes the control routine shown in FIG. 8 for switching between operational modes.

At step S44, the control system determines if the image recording operation has been completed. If so, control continues to step S45. Otherwise, control returns to step S41.

At step S45, the control system initializes and starts the timer M2. Next, at step S46, the control system executes the control routine shown in FIG. 10 for monitoring the toner temperature after image recording.

Figure 8:
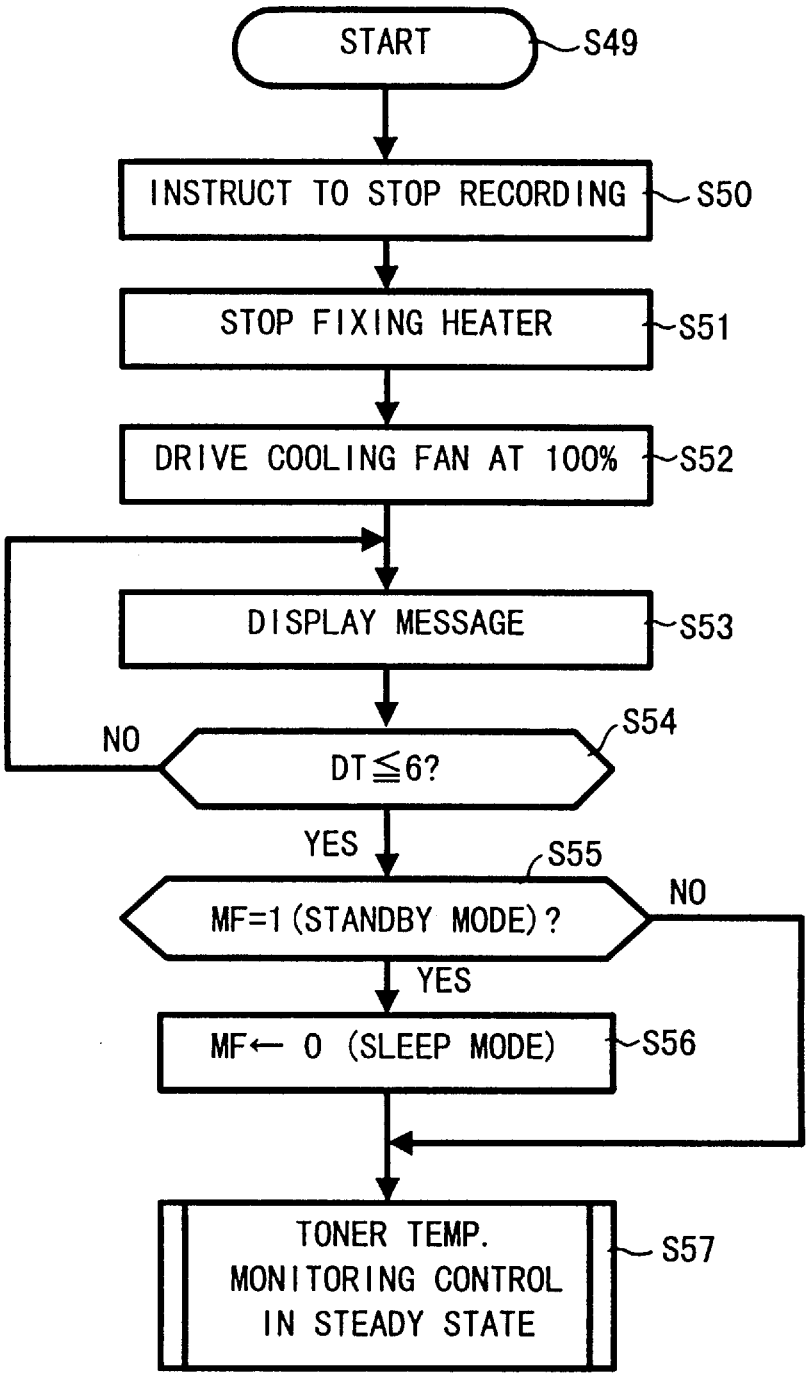
FIG. 8 is a flowchart of a preferred control routine for switching between operational modes.

FIG. 8 shows a preferred control routine for switching between operational modes. The routine starts at S49 and proceeds to step S50, where the control system sends an instruction to the recording control apparatus to stop an image recording operation.

At step S51, the control system stops the energization of the fixing heater 51. Control then continues to step S52, where the control system drives the cooling fan 5 at 100% capacity. Control then continues to step S53.

At step S53, the control system displays an error message, preferably "WAIT UNTIL TEMPERATURE DECREASES TO RECORD-POSSIBLE LEVEL". on the display 8B. Next, at step S54, the control system determines if the toner temperature DT is less than or equal to the set protective temperature T6, which is 48° C. in the low temperature mode and 46° C. in the high temperature mode. The set protective temperature T6 corresponds to an estimated toner temperature of 43° C. If the toner temperature DT is less than or equal to the set protective temperature T6, control continues to step S55. Otherwise, control returns to step S53.

At step S55, the control system determines if the facsimile apparatus 1 is in a standby mode by determining if the mode flag MF is set to 1. If so, control continues to step S56. Otherwise, control jumps to step S57.

At step S56, the control system switches the facsimile apparatus to the sleep mode by setting the mode flag MF to zero. Control then continues to step S57, where the control system executes the control routine, described below, for monitoring the toner temperature during a steady state.

Figure 9:
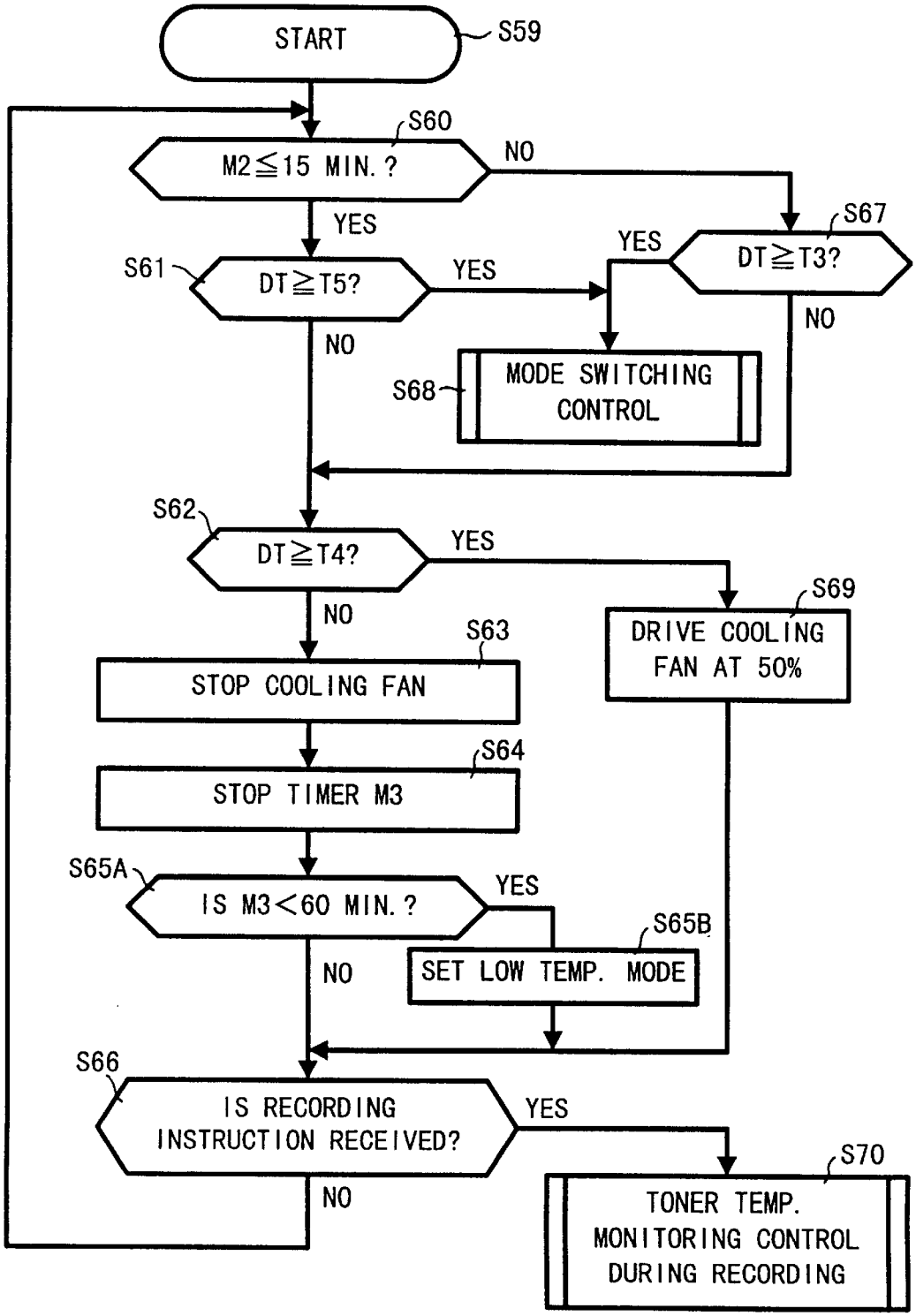
FIG. 9 is a flowchart of a preferred control routine for monitoring toner temperature during a steady state.

FIG. 9 shows a preferred control routine for monitoring the toner temperature during a steady state. The routine starts at step S59 and proceeds to step S60, where the control system determines if the elapsed time after the end of image recording is less than or equal to 15 minutes by determining if the count value of the timer M2 is less than or equal to 15 minutes. If so, control continues to step S61. Otherwise, control jumps to step S67.

At step S61, the control system determines if the toner temperature DT is greater than or equal to the set protective temperature T5. Although the set protective temperature T3 is normally used to evaluate the toner temperature DT during the steady state when image recording is not being performed, the set protective temperature T5 is preferably used for the first 15 minutes after the image recording operation ends. This is because during the first 15 minutes after the image recording operation ends, the detected toner temperature may remain above the set protective temperature T3. Thus, the use of the set protective temperature T5, during the first 15 minutes after the end of the image recording operation, will prevent unnecessary protective temperature errors.

If the toner temperature DT is not greater than or equal to the set protective temperature T5, control continues to step S62. Otherwise, control jumps to step S68.

At step S62, the control system determines if the toner temperature DT is greater than or equal to the set protective temperature T4, which is 41° C. in both the low temperature and high temperature modes. The set protective temperature T4 corresponds to an estimated toner temperature of 43° C. If the toner temperature DT is not greater than or equal to the set protective temperature T4, control continues to step S63. Otherwise, control jumps to step S69.

At step S63, the control system stops driving the cooling fan 5. Next, at step S64, the control system stops the timer M3. Control then continues to step S65A, where the control system determines if the count value of the timer M3 indicates an elapsed time of less than 60 minutes. If so, the control system determines that the toner temperature DT has decreased to the set protective temperature T4 in a relatively short period of time, and control continues to step S65B. Otherwise, control jumps to step S66.

At step S65B, the control system sets a low temperature mode. Control then continues to step S66, where the control system determines if an image recording instruction has been received. If an image recording instruction has not been received, control returns to step S60. Otherwise, control continues to step S70. At step S70, the control system executes the control routine shown in FIG. 7 for monitoring the toner temperature during recording.

At step S67, the control system determines if the toner temperature DT is greater than or equal to the set protective temperature T3. If so, control continues to step S68, where the control system executes the control routine shown in FIG. 8 for switching between operational modes. Otherwise, control jumps to step S62.

At step S69, the control system drives the cooling fan 5 at 50% capacity. Control then jumps to step S66.

Figure 10:
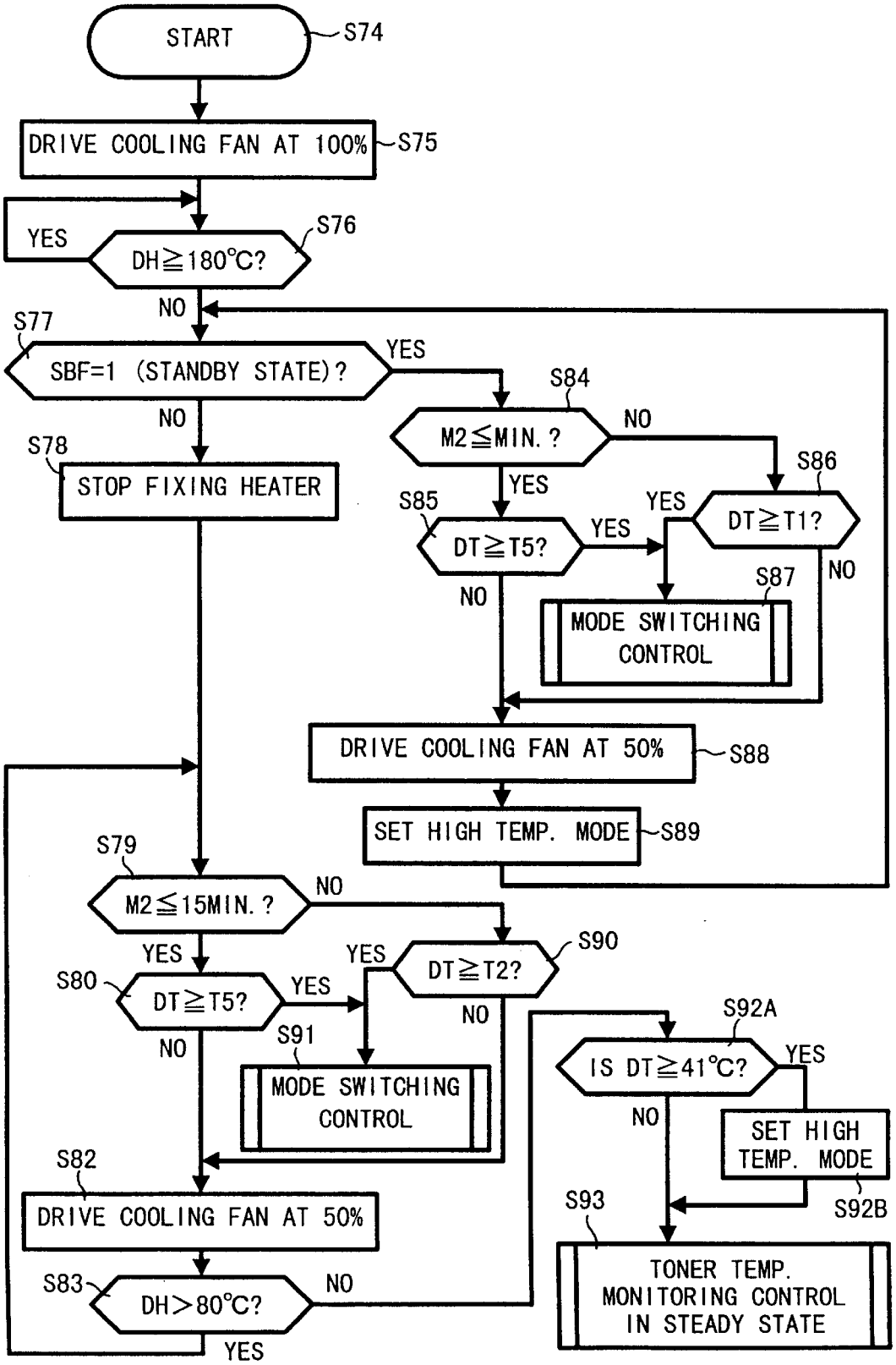
FIG. 10 is a flowchart of a preferred control routine for monitoring toner temperature after image recording.

FIG. 10 shows a preferred control routine for monitoring the toner temperature after image recording. The routine starts at step S74 and proceeds to step S75, where the control system drives the cooling fan 5 at 100% capacity.

Next, at step S76, the control system detects the temperature DH of the heat roller 52 with the heater temperature detecting sensor 7. The control system then determines if the heat roller temperature DH is greater than or equal to 180° C. If the temperature DH is not greater than or equal to 180° C., control continues to step S77. Otherwise, the control system repeats step S76 until the heater roller temperature DH is less than 180° C.

At step S77, the control system determines if the facsimile apparatus 1 is in a standby state by determining if the standby state flag SBF is set to 1. If the facsimile apparatus 1 is not in a standby state, control continues to step S78. Otherwise, control jumps to step S84.

At step S78, the control system stops the energization of the fixing heater 51. Next, at step S79, the control system determines if the elapsed time after image recording is less than or equal to 15 minutes by determining if the count value of the timer M2 is less than or equal to 15 minutes. If the count value of the timer M2 is less than or equal to 15 minutes, control continues to step S80. Otherwise, control jumps to step S90.

At step S80, the control system determines if the toner temperature DT is greater than or equal to the set protective temperature T5. As explained above, the set protective temperature T5 is used in place of the set protective temperature T2 normally used when the sleep state has been established, in order to prevent unnecessary protective temperature errors during the first 15 minutes after the end of a recording operation. If the toner temperature DT is less than the set protective temperature T5, control continues to step S82. Otherwise, control jumps to step S91.

At step S82, the control system drives the cooling fan 5 at 50% capacity. Next, at step S83, the control system determines if the heat roller temperature DH is greater than 80° C. If so, control returns to step S79. Otherwise, control jumps to step S92A. At step S92A, the control system determines if the toner temperature DT is greater than or equal to 41° C. If so, control continues to step S92B. Otherwise, control jumps to step S93.

At step S92B, the control system sets a high temperature mode. Control then continues to step S93. At step S93, the control system executes the control routine shown in FIG. 9 for monitoring the toner temperature during a steady state.

At step S90, the control system determines if the toner temperature DT is greater than or equal to the set protective temperature T2. If so, control continues to step S91. Otherwise, control jumps to step S82.

At step S91, the control system executes the control routine shown in FIG. 8 for switching between operational modes.

At step S84, the control system determines if the elapsed time since the end of the image recording operation is less than or equal to 15 minutes by determining if the count value of the timer M2 is less than or equal to 15 minutes. If the elapsed time since the end of the image recording operation is less than or equal to 15 minutes, control continues to step S85. Otherwise, control jumps to step S86.

At step S85, the control system determines if the toner temperature DT is greater than or equal to the set protective temperature T5. If so, control jumps to step S87. Otherwise, control continues to step S88. At step S88, the control system drives the cooling fan 5 at 50% capacity. Next, at step S89, the control system sets the high temperature mode. Control then returns to step S77.

At step S87, the control system executes the control routine shown in FIG. 8 for switching between operational modes.

At step S86, the control system determines if the toner temperature DT is greater than or equal to the set protective temperature T1. If so, control continues to step S87. Otherwise, control jumps to step S88.

As described, the temperature of the toner 37 contained in the toner box 35 is detected based on the output from the toner temperature detecting sensor 6. If the detected temperature of the toner 37 causes a protective temperature error, the standby mode, if so set, is forcibly switched to the sleep mode. Since the energization of the. fixing heater 51 is stopped when the sleep mode is set, heat generation by the fixing heater 51 is reduced, thereby reducing the temperature increase inside the facsimile apparatus 1. Thus, the temperature of the toner 37 can be reduced to a sufficiently low level, thereby substantially preventing the occurrence of a protective temperature error during the next image recording operation. Furthermore, since the temperature of the toner 37 is reduced to a sufficiently low level, melting of the toner 37 will be substantially prevented.

In addition, the high temperature mode is set when the high temperature mode setting conditions are satisfied. Specifically, the high temperature mode is set when the environmental temperature is high and the internal temperature of the facsimile apparatus 1 is relatively high. In other cases, the low temperature mode is set. Further, for each of the set protective temperatures T1–T3, T5 and T6, a high temperature mode set protective temperature and a low temperature mode set protective temperature, which is higher than the high temperature mode set protective temperature, is stored in the set protective temperature memory 91A of the ROM 91. During the high temperature mode, the high temperature mode set protective temperature is used to evaluate the toner temperature. Accordingly, temperature increases inside the facsimile apparatus are reduced and, therefore, the toner temperature is kept within a safe range. When the low temperature mode, which is set when the environmental temperature and the internal temperature of the facsimile apparatus 1 are relatively low, the low temperature mode set protective temperatures, which are higher than the high temperature mode set protective temperatures, are used as to evaluate the toner temperature so that protective temperature errors will be substantially prevented.

Further, the recording set protective temperature T5 normally used during image recording, and the waiting set protective temperatures T1–T3, that are lower than the recording set protective temperature T5 and that are normally used when image recording is not being performed, are provided as the set protective temperatures stored in the set protective temperature memory 91A. During the first 15 minutes after an image recording operation ends, the recording set protective temperature T5 is used instead of the waiting set protective temperatures T1–T3 because the temperature of the toner decreases slowly after image recording, even if the cooling fan 5 is operated. Therefore, unnecessary protective temperature errors after image recording will be substantially prevented. Fifteen minutes after the image recording operation ends, the waiting set protective temperature T1, T2 or T3 is used for evaluating the toner temperature.

Figure 2:
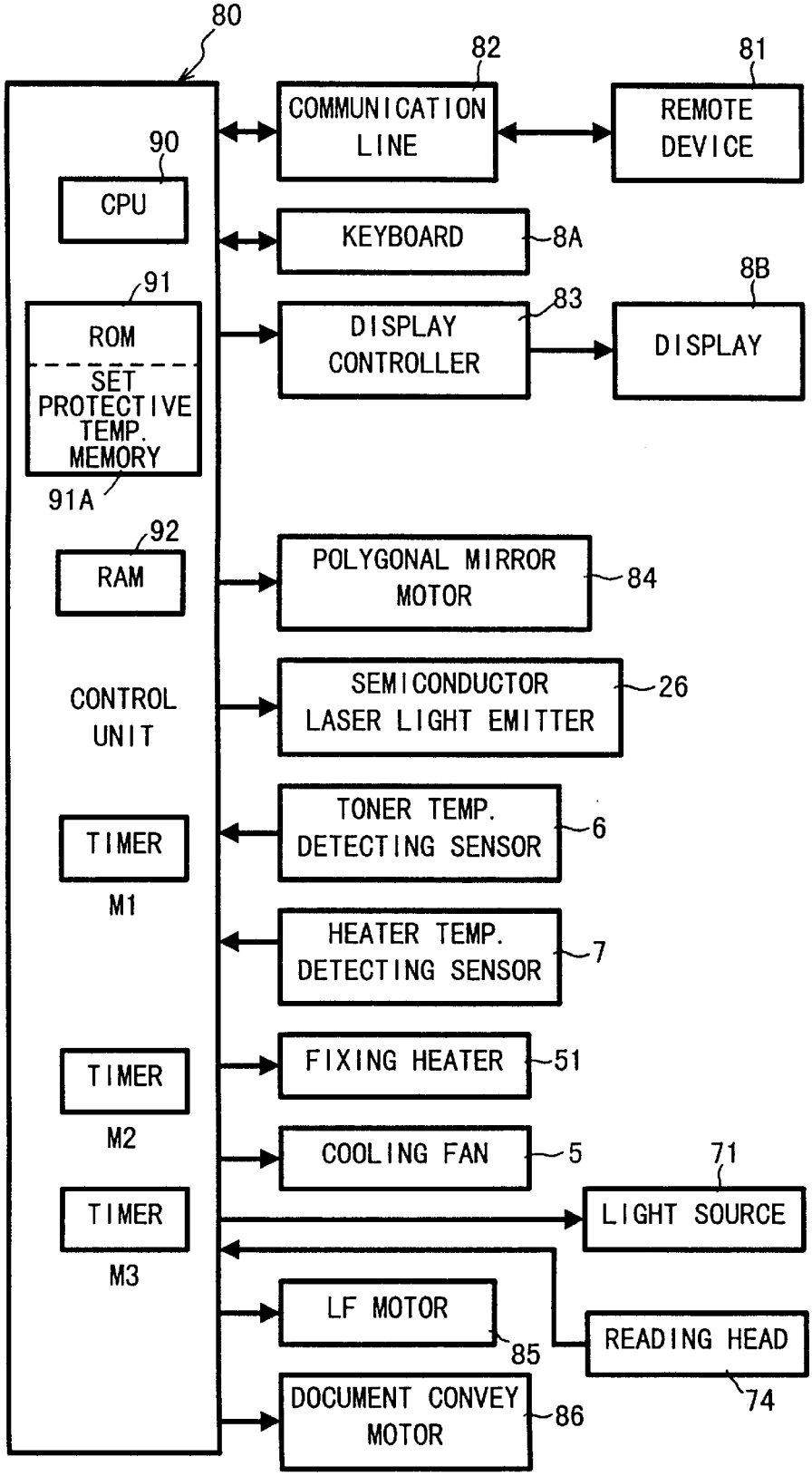
FIG. 2 is a block diagram of a control system used with the facsimile apparatus of FIG. 1.

As shown in FIG. 2, the control system for the image forming apparatus of this invention is preferably implemented on a programmed general purpose computer. However, the control system can also be implemented on a special purpose computer, a programmed microprocessor or microcontroller and peripheral integrated circuit elements, an ASIC or other integrated circuit, a hardwired electronic or logic circuit such as a discreet element circuit, a programmable logic device such as a FPGA, PLD, PLA or PAL, or the like. In general, any device in which a finite state machine capable of implementing the flow charts shown in FIGS. 4–10 can be used to implement the control system.

The control program outlined in FIGS. 4–10, including the table of predetermined temperatures T1–T6 of FIG. 3, is stored in internal memory (e.g., ROM 91) of the facsimile apparatus 1. Thus, ROM 91 is a recording medium that stores a control program for use by the control unit 80 to perform the control procedures described above. The control program can be stored in memory (e.g., ROM 90) in advance, for example, by the manufacturer or retailer of the facsimile apparatus.

Alternatively, the control program, including the predetermined set temperature values, T1–T6 can be provided separately from the facsimile apparatus 1, for example, on CD-ROM or other storage media that can be purchased by the user and subsequently stored (permanently or temporarily) in internal memory of the facsimile apparatus. The program also can be provided to the user over a communications network such as, for example, the Internet (World Wide Web). Thus, the recording medium can be internal ROM or RAM (volatile or non-volatile) of the facsimile apparatus, or a separate memory such as a CD-ROM, floppy disk, etc.

While this invention has been described in conjunction with the specific embodiments outlined above, it is evident that many alternatives, modifications and variations will be apparent to those skilled in the art.

For example, in the mode control routine shown in FIG. 8, if a recording operation is stopped during the standby mode (MF=1), the set length of time to maintain the standby state, during which the fixing heater 51 is kept at about 135° C., may be forcibly changed from 15 minutes to a reduced length of time, e.g., about 1–3 minutes, instead of switching to the sleep mode (MF=0).

In addition, it may be preferable to adjust the differences between the high temperature mode set protective temperatures and the low temperature mode set protective temperatures, or to adjust the conditions for setting the high temperature mode or the low temperature mode, in accordance with changes in environmental temperature.

In addition to providing the standby mode as described above, a constant standby mode may also be provided during which the fixing heater 51 is constantly and continuously kept at a predetermined temperature every time a recording operation ends. The two standby modes can be switchably set by, for example, forcibly switching the constant standby mode to the standby mode in steps S55 and S56 of the control routine of FIG. 8.

Thus, if a protective temperature error is caused by the toner temperature exceeding the set protective temperature T5 when the constant standby mode has been set, the mode can be forcibly switched to the standby mode described above. Since, in the standby mode, the energization of the fixing heater 51 is discontinued upon the elapse of a predetermined length of time after an image recording operation, the temperature of the toner 37 can be reduced in a relatively short period of time, thereby significantly reducing the possibility of protective temperature error during the next recording operation.

Further, it should be apparent that the present invention may also be applied to an image forming apparatus that forms a toner image by electrostatically controlling the passage of a toner through a plurality of small apertures formed in a single line in a sheet-shaped aperture electrode, or other image forming apparatus, such as copying machines, laser printers and the like.

Accordingly, the preferred embodiments of the invention as set forth above are intended to be illustrative, not limiting. Various changes may be made without departing from the spirit and scope of the invention as defined in the following claims.

What is claimed is:

1. An image forming apparatus, comprising:

temperature detecting means for detecting a temperature of toner contained in a toner container;

recording prohibiting means for prohibiting an image recording operation when the temperature detected by the temperature detecting means exceeds a predetermined set protective temperature;

mode setting means for selectively setting an operational mode that is applied after an end of an image recording operation, the operational mode being selected from a plurality of operational modes; and mode switching means for switching a set operational mode to another operational mode if an image recording operation is prohibited by the recording prohibiting means.

2. The image forming apparatus of claim 1, wherein the mode setting means selectively sets a first operational mode or a second operational mode, wherein the first operational mode establishes a standby state in which a fixing heater is kept at a predetermined temperature for a predetermined period of time, after which the standby state is terminated and the fixing heater is turned off if another image recording operation has not started, and wherein the second operational mode causes the fixing heater to be continuously kept at a predetermined temperature after the image recording operation ends.

3. The image forming apparatus of claim 2, wherein the mode switching means switches the second operational mode to the first operational mode when an image recording operation is prohibited by the recording prohibiting means when in the second operational mode.

4. The image forming apparatus of claim 1, wherein the mode setting means selectively sets a first operational mode or a second operational mode, wherein the first operational mode establishes a standby state in which a fixing heater is kept at a predetermined temperature for a predetermined period of time, after which the standby state is terminated and the fixing heater is turned off if another image recording operation has not started, and wherein the second operational mode causes the fixing heater to be immediately turned off after the image recording operation ends.

5. The image forming apparatus of claim 4, wherein the mode switching means switches the first operational mode to the second operational mode when an image recording operation is prohibited by the recording prohibiting means when in the first operational mode.

6. An image forming apparatus, comprising:

temperature detecting means for detecting a temperature of toner contained in a toner container;

recording prohibiting means for prohibiting an image recording operation when the temperature detected by the temperature detecting means exceeds a predetermined set protective temperature;

heater control means for maintaining a standby state in which a fixing heater is kept at a predetermined temperature for an initial predetermined time period after an image recording operation ends, the heater control means terminating the standby state if another image recording operation is not initiated within the initial predetermined period of time; and set time changing means for changing the initial predetermined time period to a second predetermined time period when an image recording operation is prohibited by the recording prohibiting means, wherein the second predetermined time period is shorter than the initial predetermined time period so that the standby state is maintained for a shorter length of time.

7. An image forming apparatus, comprising:

temperature detecting means for detecting a temperature of toner contained in a toner container;

recording prohibiting means for prohibiting an image recording operation when the temperature detected by the temperature detecting means exceeds one of at least two predetermined set protective temperatures; and mode setting means for setting a high temperature mode when predetermined high temperature mode setting conditions are satisfied, and for otherwise setting a low temperature mode;

wherein the at least two predetermined set protective temperatures comprise at least one high temperature predetermined set protective temperature used by the recording prohibiting means when the high temperature mode is set and at least one low temperature predetermined set protective temperature used by the recording prohibiting means when the low temperature mode is set.

8. The image forming apparatus of claim 7, wherein each of the at least one high temperature predetermined set protective temperature and the at least one low temperature predetermined set protective temperature comprise a predetermined recording set protective temperature that is used by the recording prohibiting means while an image recording operation is being performed, and a predetermined waiting set protective temperature, that is lower than the recording set protective temperature, and that is otherwise used by the recording prohibiting means.

9. The image forming apparatus of claim 7, wherein the predetermined high temperature mode setting conditions are satisfied when an internal temperature of the image forming apparatus exceeds a predetermined value.

10. The image forming apparatus of claim 9, wherein the predetermined value is approximately 35 degrees Celsius.

11. An image forming apparatus, comprising:

temperature detecting means for detecting a temperature of toner contained in a toner container; and recording prohibiting means for prohibiting an image recording operation when the temperature detected by the temperature detecting means exceeds one of at least two predetermined set protective temperatures;

wherein the at least two predetermined set protective temperatures comprise a predetermined recording set protective temperature that is used by the recording prohibiting means while an image recording operation is being performed, and a predetermined waiting set protective temperature, that is lower than the recording set protective temperature, and that is otherwise used by the recording prohibiting means;

the recording prohibiting means determining, during a predetermined period of time after an image recording operation is stopped, whether to prevent another image recording operation based on the predetermined recording set protective temperature.

12. A recording medium that stores a control program for use in controlling an image forming apparatus, the control program including instructions for causing a controller of the image forming apparatus to:

detect a temperature of toner contained in a toner container in the image forming apparatus;

prohibit an image recording operation when the detected temperature exceeds a predetermined set protective temperature; and switch a set operational mode of the image forming apparatus from a first operational mode to a second operational mode when the image recording operation is prohibited.

13. The recording medium of claim 12, wherein the second operational mode establishes a standby stated in which a fixing heater of the image forming apparatus is kept at a predetermined temperature for a predetermined period of time, after which the standby state is terminated and the fixing heater is turned off if another image recording operation has not started, and wherein the first operational mode causes the fixing heater to be continuously kept at a predetermined temperature after the image recording operation ends.

14. The recording medium of claim 12, wherein the first operational mode establishes a standby state in which a fixing heater of the image forming apparatus is kept at a predetermined temperature for a predetermined period of time, after which the standby state is terminated and the fixing heater is turned off if another image recording operation has not started, and wherein the second operational mode causes the fixing heater to be immediately turned off after the image recording operation ends.

15. A recording medium that stores a control program for use in controlling an image forming apparatus, the control program including instructions for causing a controller of the image forming apparatus to:

detect a temperature of toner contained in a toner container in the image forming apparatus;

prohibit an image recording operation when the detected temperature exceeds a predetermined set protective temperature; and change a predetermined time period that a fixing heater of the image forming apparatus is maintained at a predetermined standby temperature after an image recording operation ends from a first time period to a second time period, shorter than the first time period, when the image recording operation is prohibited.

16. A recording medium that stores a control program for use in controlling an image forming apparatus, the control program including instructions for causing a controller of the image forming apparatus to:

detect a temperature of toner contained in a toner container in the image forming apparatus;

set a protective temperature to at least one high temperature predetermined set protective temperature when predetermined high temperature mode setting conditions are satisfied, otherwise set the protective temperature to at least one low temperature predetermined set protective temperature; and prohibit an image recording operation when the detected temperature exceeds the set protective temperature.

17. The recording medium of claim 16, wherein each of the at least one high temperature predetermined set protective temperature and the at least one low temperature predetermined set protective temperature comprise a predetermined recording set protective temperature that is set while an image recording operation is being performed, and a predetermined waiting set protective temperature, that is lower than the recording set protective temperature, and that is otherwise set.

18. The recording medium of claim 16, wherein the predetermined high temperature mode setting conditions are satisfied when an internal temperature of the image forming apparatus exceeds a predetermined value.

19. A recording medium that stores a control program for use in controlling an image forming apparatus, the control program including instructions for causing a controller of the image forming apparatus to:

detect a temperature of toner contained in a toner container in the image forming apparatus;

set a protective temperature to a predetermined recording set protective temperature while an image recording operation is being performed by the image forming apparatus, otherwise set the protective temperature to a predetermined waiting set protective temperature that is lower than the recording set protective temperature; and prohibit an image recording operation when the detected temperature exceeds the set protective temperature.

20. The recording medium of claim 19, wherein the control program also includes instructions to:

maintain the protective temperature at the predetermined recording set protective temperature for a predetermined time period after a recording operation was stopped.

* * * * *